US007373673B1

(12) United States Patent
Holland

(10) Patent No.: US 7,373,673 B1
(45) Date of Patent: May 20, 2008

(54) TARGET BUILT INTO A TOILET OR URINAL

(76) Inventor: Gloria L. Holland, 94 Dahlgren Ave., Portsmouth, VA (US) 23702

( * ) Notice: Subject to any disclaimer, the term of this patent is extended or adjusted under 35 U.S.C. 154(b) by 0 days.

(21) Appl. No.: 11/415,686

(22) Filed: May 2, 2006

(51) Int. Cl.
*A47K 17/00* (2006.01)

(52) U.S. Cl. ..... 4/661; 4/902

(58) Field of Classification Search ..... 4/661, 4/902, DIG. 5
See application file for complete search history.

(56) References Cited

U.S. PATENT DOCUMENTS 4,044,405 A * 8/1977 Kreiss ..... 434/247
6,385,785 B1 * 5/2002 Linden ..... 4/300.3

* cited by examiner

*Primary Examiner*—Huyen Le
(74) *Attorney, Agent, or Firm*—William G. Sykes

(57) ABSTRACT

A target permanently manufactured into a toilet or urinal. The target is used as a self competitive game, that triggers the subconscious mind as a training aide to revolutionize the world in health and hygiene. The user scores points by hitting the target in different locations. Closer to the center gives the individual more points.

2 Claims, 4 Drawing Sheets

15

TARGET BUILT INTO A TOILET OR URINAL

REFERENCES CITED

U.S. PATENT DOCUMENTS

| | | |
|---|---|---|
| 4,044,405 | August 1977 | Kreiss |
| 6,385,796 B1 | May 2002 | Muir |
| 6,513,173 B1 | February 2003 | Sykes |
| 6,908,392 B2 | June 2005 | Friedman |

BACKGROUND OF THE INVENTION

Attracting the attention of urinating males to help in toilet training and to aid in keeping toilets, urinals and the surrounding areas clean has long been a desire.

Parents, janitors, and others responsible for the cleanliness of the urinals and toilets and the surrounding areas have had a problem for years due to the sloppiness of males urinating. This problem causes germs to spread and creates many health and hygiene problems.

Whether dealing with infants or males of other ages, it is well known that the male will direct his urine at a target if one is present. Starting in infancy at diaper change time and continuing into adulthood the male will aim at a target if one is present. The male in general is very competitive. Males from a young age have entered into urinating contest with other males when standing in the snow or near the water.

One of the directors of design for American Standard wrote that considerable thought has gone into the design of modern urinals in order to eliminate splash back. The rear wall of the typical urinal is parabolic in cross section when viewed from above, and the porcelain finish is conducive to laminar flow. The principles of fluid dynamics tell us that a fluid striking a smooth surface at an oblique angle will tend to flow along that surface. Assuming the source of the fluid is near the focal point of the parabola—and modesty makes it unlikely he'll stray too far—the fluid will run straight down the urinal wall with little or no splashing. The center of the target in the urinal in our invention is located at the focal point of the parabola to direct the attention of the urinating male.

Using the target as a self competitive game from a young age helps program the subconscious mind and will improve the aim of the male. This self competitive game of aiming at a target in a toilet or urinal is a brain stimulus and the subconscious mind will be programmed to always aim at the same point in the toilet or urinal. After the subconscious mind is properly programmed the aim of the male will be substantially improved whether or not the target is used. The male will always aim at the same point in the toilet or urinal.

BRIEF DESCRIPTION OF THE PRIOR ART

A study of the prior art reveals that various types of devices for attracting the attention of human males are known.

One of these is a rotatable propeller suspended by struts over a toilet. The struts are connected by a ball and socket arrangement to a suction cup which is in turn attached to the external side of the toilet. The invention is taught by U.S. Pat. No. 2,703,407 issued to R. E. Henock et al on Mar. 8, 1955.

Other types of devices are known which sense a change in weight or water level in the toilet bowl and cause music or chime box to become active.

Another is a target that is glued into the urinal or toilet. The invention is taught by U.S. Pat. No. 3,044,405 issued to Joel S. Kreiss on Aug. 30, 1977. This invention causes a sanitary problem by creating areas around the target and in the glue that can not be properly cleaned.

DESCRIPTION OF THE INVENTION

Figure 1:
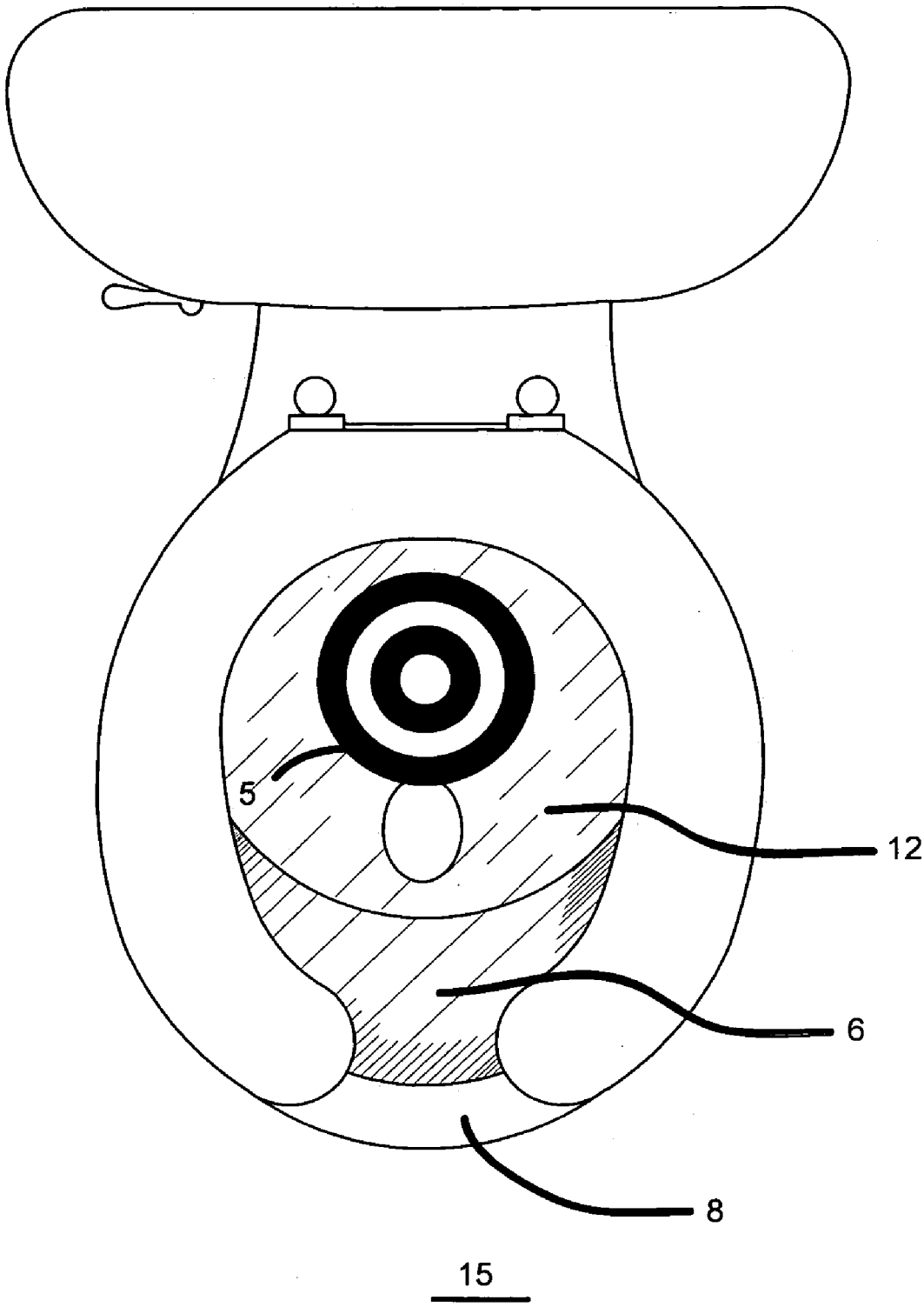
FIG. 1 shows the present invention in an embodiment with a conventional toilet.
Figure 2:
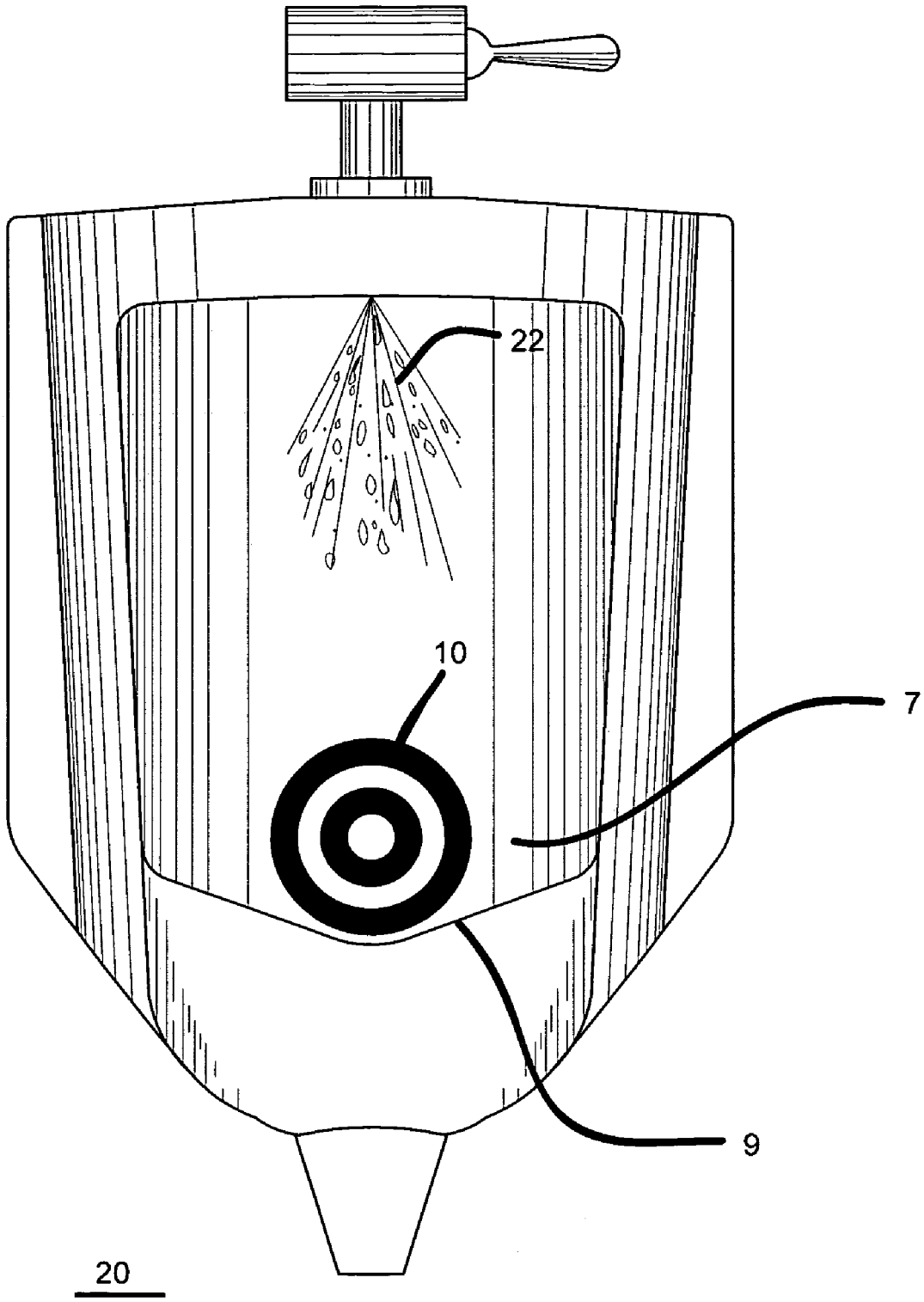
FIG. 2 shows the present invention in an embodiment with a conventional urinal.

FIGS. 1 and 2 show targets 5 and 10 disposed respectively in receptacles 15 and 20 shown as a toilet and a urinal. Target 5 is disposed below the water line 12 of the toilet and target 10 is disposed at the focal point of the parabola surface of the urinal underneath the normal flow of water 22 in the urinal.

Figure 3:
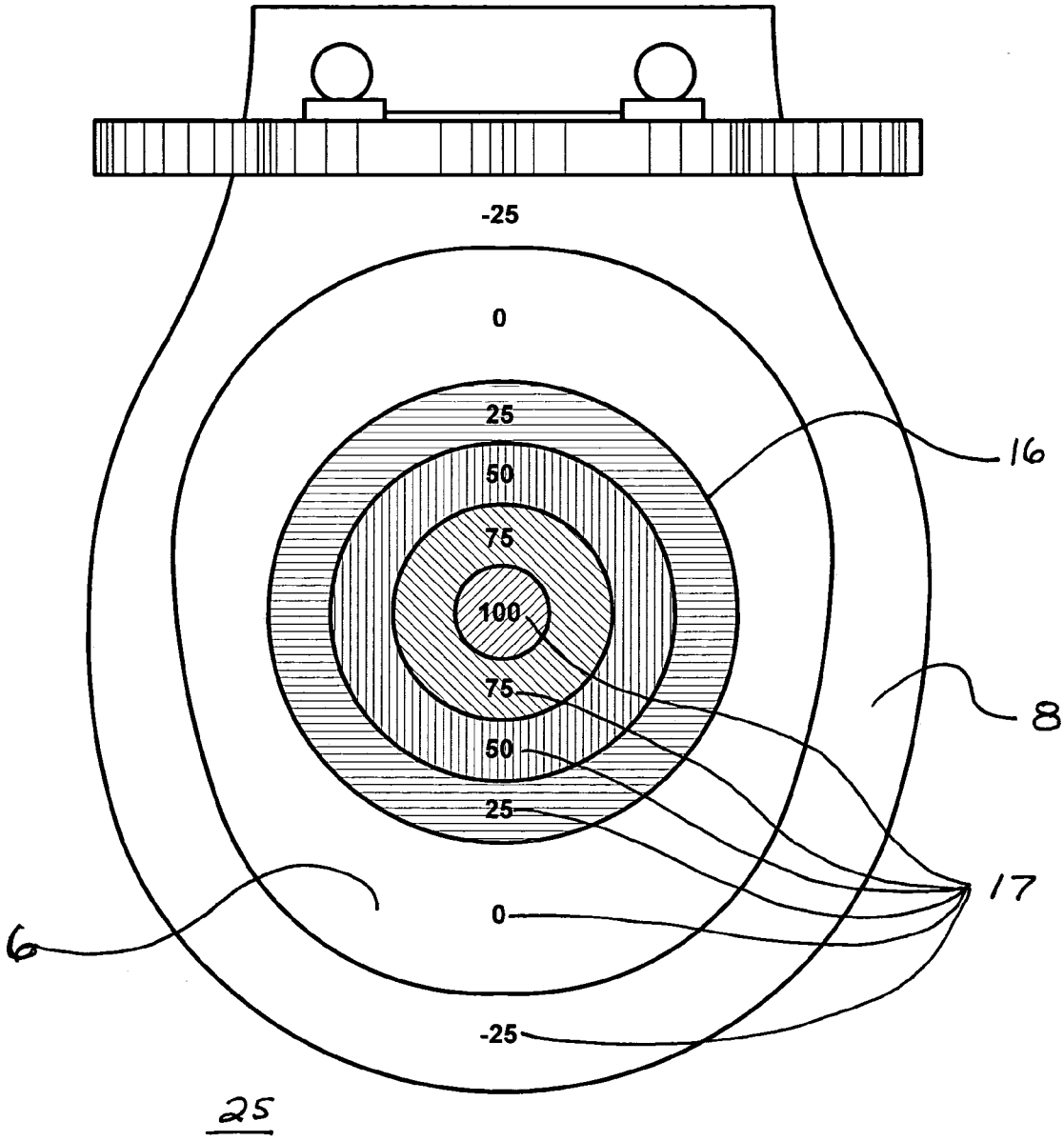
FIG. 3 shows a toilet bowl with the target and scoring numbers imprinted in the porcelain.

FIG. 3 shows a toilet bowl 25 with a target 16. The target 16 can consist of colored circles and numbers. The center circle can be red and have the number 100, the next circle can be yellow and have the number 75, the next circle can be green and have the number 50 and the next circle can be blue and have the number 25. Outside of the targets 5, 10 and 16 is the toilet bowl surface 6 and the urinal bowl surface 7. The number 0 is painted in the toilet bowl surface 6 and the urinal bowl surface 7. The toilet 15 and 25 has an outside rim 8 and the urinal 20 has an outside rim 9. The outside rims 8 and 9 are painted with the number −25.

Figure 4:
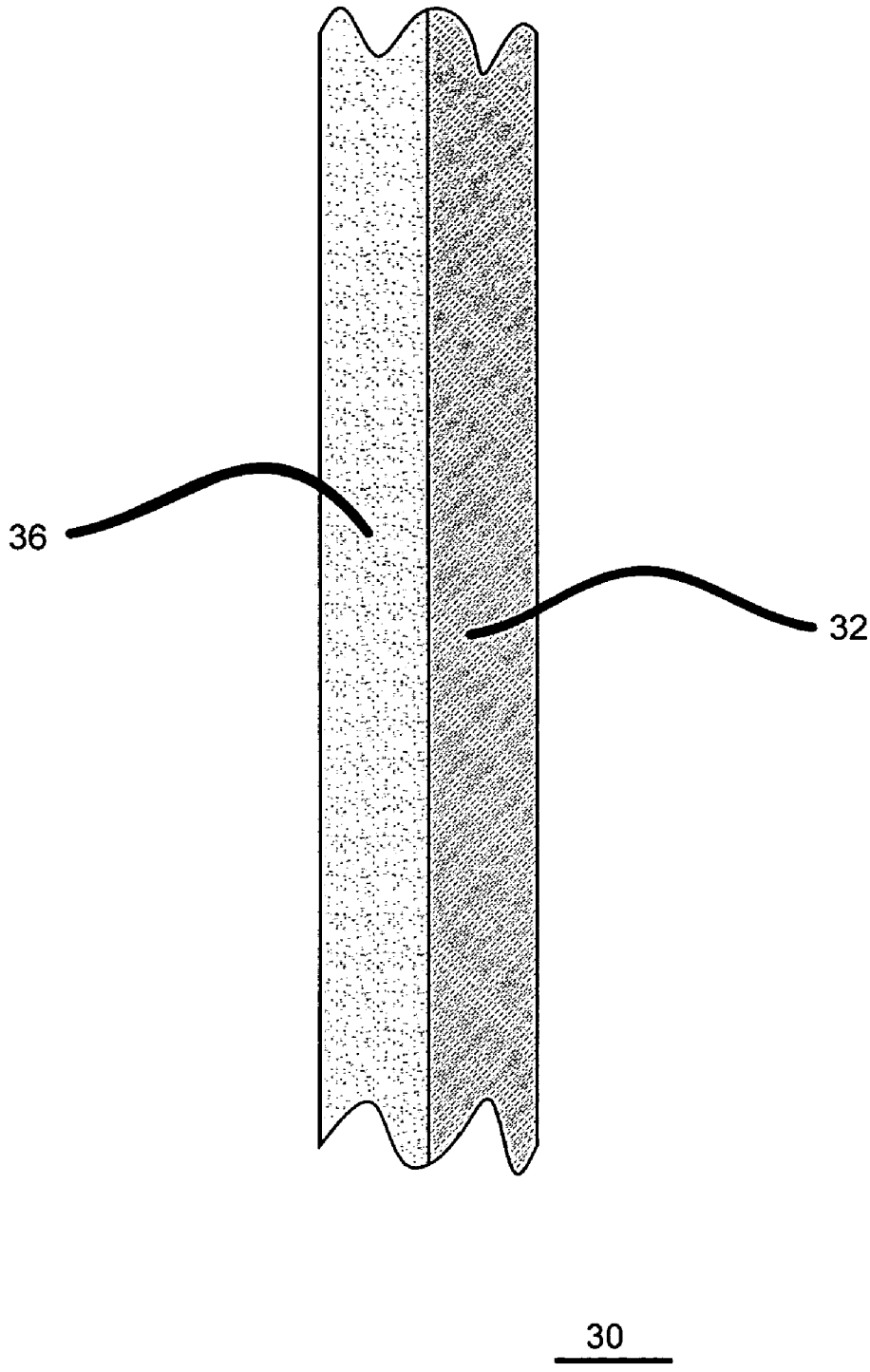
FIG. 4 shows a cross section of one embodiment of the present invention.

FIG. 4 shows a cross section view of the toilet 15 and 25 and urinal 20 wall 30. The wall 30 is constructed by slip casting clay into a mold which is then fired, turning the clay into porcelain 32 and finished with glaze 36 that is sprayed on to the porcelain and fired. The targets 5, 10 and 16 and the numbers 100, 75, 50, 25, 0 and −25 will be different color glazes sprayed onto the porcelain 32 prior to final firing. The glaze material melts and forms a glossy surface coating on the clay.

The target 10 or 15 is formed from a picture of a "bull's eye, animal or any other graphic representation, sprayed painted onto the porcelain prior to the final glazing of the toilet 15 or 25 or urinal 20.

It is to be understood that various embodiments of the invention can be combined to provide multiple purposes of the game as a training aid to improve the aim of a urinating male. Further, the above disclosure is not intended to limit the invention, but rather, the foregoing is intended to cover all modifications and alternative constructions falling within the spirit and scope of the invention.

I claim:

1. In a toilet bowl or urinal the combination comprising:

a target means to attract the attention of urinating human males to be permanently manufactured into the toilet or urinal; said target means being sprayed onto the porcelain during manufacturing after the clay is fired and prior to the final firing; and said target not being exposed to the outside of the toilet or urinal finished glazing.

2. The combination in claim 1 wherein:

said painted target comprises a permanent member of the toilet or urinal and is completely enclosed between clay and the porcelain glaze.

* * * * *